US007111972B2

(12) United States Patent
Coushaine et al.

(10) Patent No.: US 7,111,972 B2
(45) Date of Patent: Sep. 26, 2006

(54) LED LAMP WITH CENTRAL OPTICAL LIGHT GUIDE

(75) Inventors: Charles Coushaine, Rindge, NH (US); Michael Tucker, Henniker, NH (US); Thomas Tessnow, Weare, NH (US)

(73) Assignee: Osram Sylvania Inc., Danvers, MA (US)

( * ) Notice: Subject to any disclaimer, the term of this patent is extended or adjusted under 35 U.S.C. 154(b) by 74 days.

(21) Appl. No.: 10/874,599

(22) Filed: Jun. 23, 2004

(65) Prior Publication Data

US 2006/0012984 A1 Jan. 19, 2006

(51) Int. Cl.
*F21V 7/04* (2006.01)

(52) U.S. Cl. ..... 362/555; 362/226; 362/240; 362/310; 362/364

(58) Field of Classification Search ..... 362/555, 362/543–545, 548, 549, 226, 234, 235, 240, 362/310, 364; 313/113, 114, 512; 439/619, 439/699.2

See application file for complete search history.

(56) References Cited

U.S. PATENT DOCUMENTS 6,796,698 B1 * 9/2004 Sommers et al. ..... 362/555
6,880,962 B1 * 4/2005 Coushaine et al. ..... 362/555

* cited by examiner

*Primary Examiner*—Sandra O'Shea
*Assistant Examiner*—Mark Tsidulko
(74) *Attorney, Agent, or Firm*—William E. Meyer

(57) ABSTRACT

An LED lamp assembly may be formed from a support plate with a first side and a second side. A plurality of LED light sources are arranged and mounted on the first side of the support plate. An axially extending, light transmissive, light guide having an input end with an area sufficient to span the mounted LED light sources, is disposed adjacent the LED light sources to capture their emitted light. The light guide has at least one light deflector. The input end of the light guide is disposed to receive light emitted by the LED light sources and to conduct such light axially through the light guide to the deflector for projection sideways at an angle to the axis so as to appear s if the deflecting surface is a light source.

8 Claims, 10 Drawing Sheets

LED LAMP WITH CENTRAL OPTICAL LIGHT GUIDE

Basic aspect(s) of this invention is/are disclosed in copending application entitled LED LIGHT SOURCE MIMICKING A FILAMENTED LAMP, Ser. No. 10/314,714 filed by the present Applicants on Dec. 9, 2002, and the benefit of the filing date of that application is hereby claimed for this continuation in part Application.

TECHNICAL FIELD

The invention relates to electric lamps and particularly to electric lamps using LEDs as light sources. More particularly the invention is concerned with an electric lamp with LED light sources for use in an optical housing.

BACKGROUND ART

Solid-state lighting, for example, light emitting diodes (hereinafter, LED) are known for their long life and their ability to resist shock. They have been used for some time as the high-mount stop light in automobiles, where no particular amplification or reflection of the light is needed. Attempts have been made in the past to adapt LEDs for other purposes such as taillight units; however, these attempts have applied LEDs typically encased in plastic beads to flat surfaces, which were then ganged on the cylindrical end of, for example, a bayonet base. Little or no light was directed to the reflector for proper light distribution. For the most part, these devices do not meet Federal regulations.

DISCLOSURE OF INVENTION

It is, therefore, an object of the invention to obviate the disadvantages of the prior art.

It is another object of the invention to enhance the utilization of solid-state light sources.

It is yet another object of the invention enhance the utilization of solid-state light sources in automotive applications.

These objects are accomplished, in one aspect of the invention, by the provision of a solid-state light source that is compatible with existing sockets normally reserved for filamented lamps. The light source comprises a hollow base that is formed to mechanically and electrically adapt to a socket and has a sub-assembly adapted to cooperate with and fit into the hollow base. The sub-assembly comprises a circuit board that has a plurality of solid-state light sources mechanically and electrically connected to one side of the circuit board. Two electrical contacts are positioned on the other side of the circuit board for connection to an electrical circuit. A light pipe covers the plurality of light sources and extends away therefrom to a terminal end. A light radiator is affixed to the terminal end and a light-opaque shroud surrounds the light pipe.

In a preferred embodiment of the invention the light radiator is formed to mimic the light distribution of a filamented lamp and the centerline of the radiator is the same distance from the base as would be the centerline of a filamented lamp. This procedure allows the solid-state light source to mimic the light distribution of a typical incandescent lamp.

BRIEF SUMMARY OF THE INVENTION

An LED lamp assembly may be formed from a heat conductive support plate with a first side and a second side. A plurality of LED light sources are arranged and mounted on the first side of the support plate. An axially extending, light transmissive, light guide having an input end with an area sufficient to span the mounted LED light sources, is disposed adjacent the LED light sources to capture the emitted light. The light guide has at least one light deflector at a distal end. The light guide receives light emitted by the LED light sources, conducts such light axially to the deflector for projection sideways at an angle to the axis.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
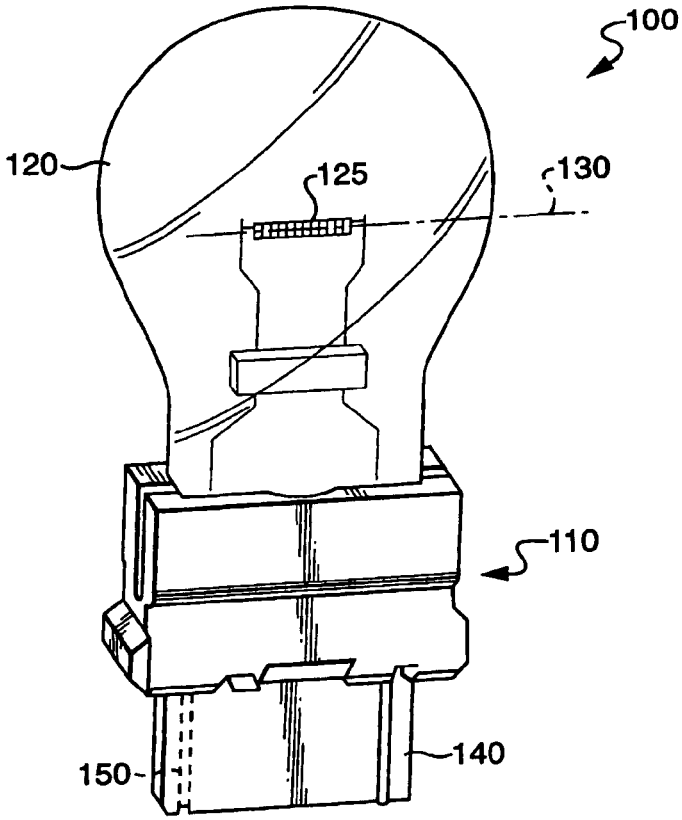
FIG. 1 PRIOR ART
FIG. 1 is a perspective view of a prior art filamented lamp.

Referring now to FIG. 1 there is shown a prior art lamp for use with automobiles. The lamp 100 has a base 110 that is formed to fit with a standard socket, for example, of the type used for automobile taillights. The light source 120 is an incandescent bulb having a filament 125 arrayed along an axis 130. The height of the axis 130 is designed to mate effectively with the reflector with which the lamp is used. The electrical contacts 140 and 150 are fitted to the outside of the base 110, one on either side. There are millions of sockets available that accept this type of base and its associated incandescent bulb. The bulbs, of course, are replaceable since the filament has a limited life.

Figure 2:
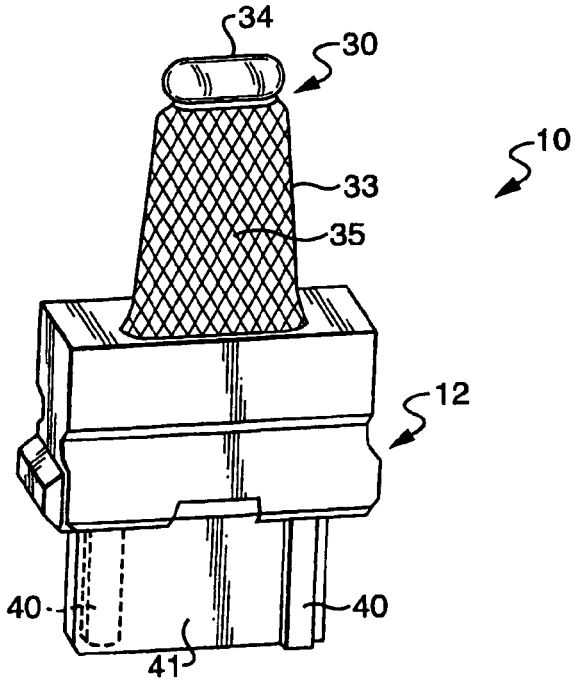
FIG. 2 is a perspective view of an embodiment of this invention.
Figure 3:
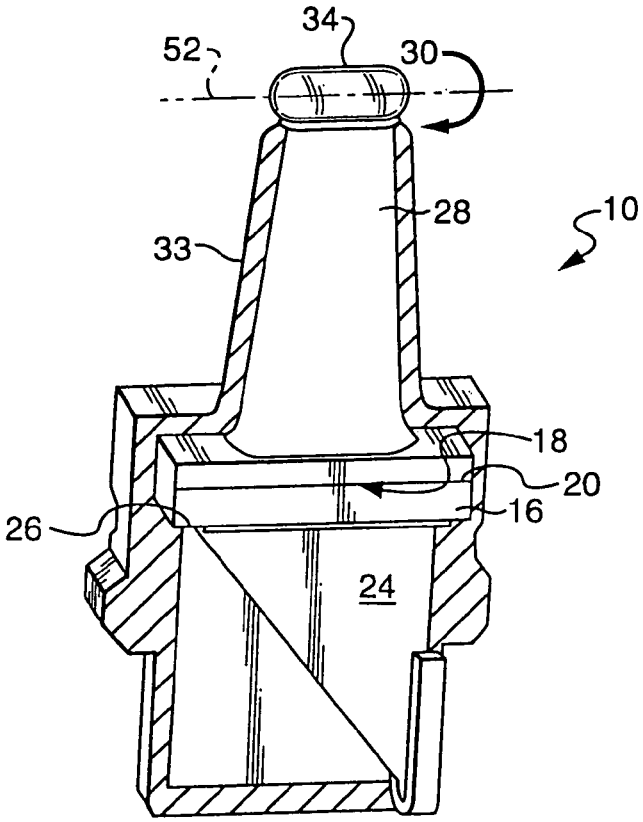
FIG. 3 is a perspective view of an embodiment of the invention, partially in section.
Figure 4:
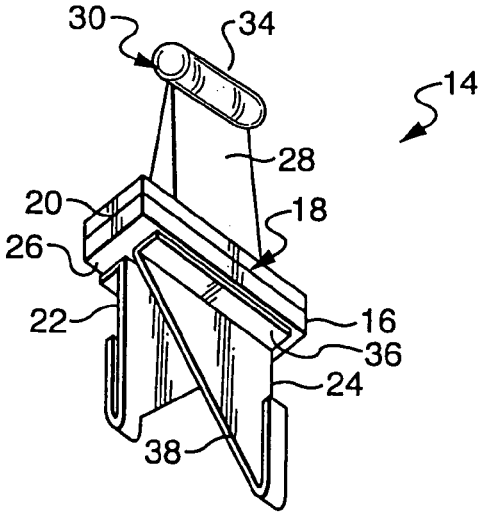
FIG. 4 is a perspective view of a sub-assembly of the invention.

Referring now to FIG. 2 there is shown a solid-state light source 10 that is compatible with the existing sockets normally reserved for filamented lamps 100. The solid-state light source 10 comprises a hollow base 12 formed to mechanically and electrically adapt to an existing socket normally reserved for lamps 100. A sub-assembly assembly 14 (see FIG. 4) is adapted to cooperate with and fit into the hollow base 12. The sub-assembly 14 comprises a circuit board 16 with a plurality of solid-state light sources 18 mechanically and electrically connected to one side 20 of the circuit board 16. In the preferred embodiment and array of LEDs are mounted on a metal core board or other substrate providing good thermal conduction. It is preferred to mount the LEDs directly as "chip on board" and not indirectly as attached LED assemblies (TOPLEDS). Direct mounting ("chip on board") enables more efficient heat sinking and therefore greater light output, or longer life for the LEDs. For example, thermally coupling the circuit board 16 to the power leads 22, 24, can provide the heat sinking. Electrical traces formed on the circuit board 16 link the LEDs in a circuit and connect to the electrical contacts 22, 24 for power. The LEDs are preferably coated with a clear epoxy or silicon coating (not shown) as known in the art. The coating protects the wire connections, can enhance the light output and spread the heat conducted from the LED chips. The coating may be formed on the surface to the circuit board 16 to fit in a corresponding cavity in the optical light pipe 28 or the coating may fill a cavity formed between the light pipe 28 and the circuit board 16 and LEDs.

Figure 6:
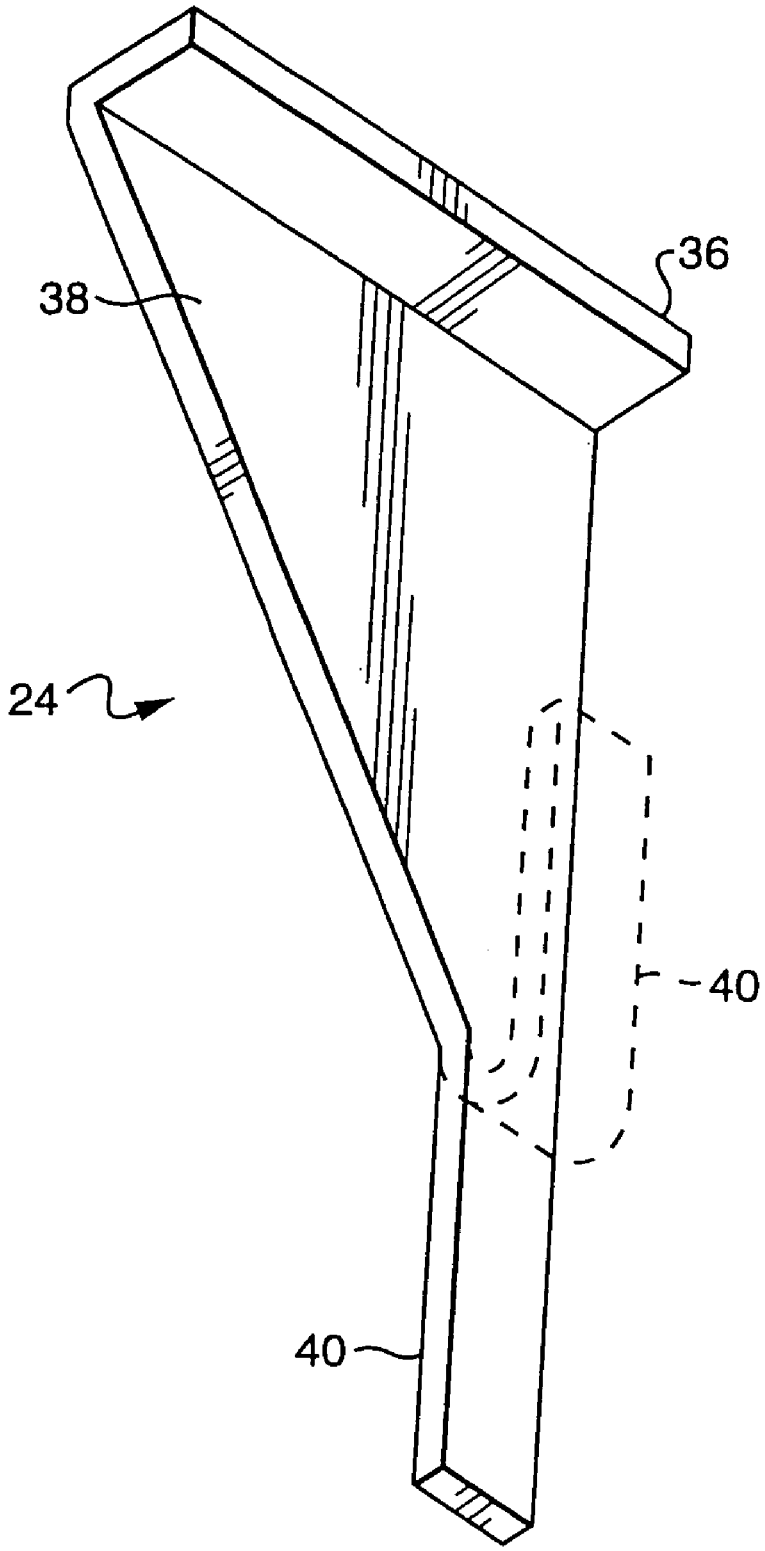
FIG. 6 is a perspective view of one of the electrical contacts useable with the invention.

Two electrical contacts 22, 24 are positioned on the other side 26 of the circuit board 16 for connection to an electrical circuit. The preferred electrical contacts 22, 24 each have an elongated flange 36, which is attached to the side 26 of the circuit board 16. The preferred electrical contacts 22, 24 include relatively large area portions, such as the triangular segment 38, that provide heat sinking for the circuit board 16. These depend from each of the flanges 36 and include terminal portions 40 that extend away from, as shown, the apex of the triangular segment 38. As shown in FIG. 6, as formed initially the terminal portion 40 extends straight away from the apex so that it can project through the bottom of the base 12. After the sub-assembly 14 is enclosed in the hollow base 12, the terminal portion 40 is bent back upon itself to seat on the external surface 41 of the base 12. The large triangular segments 38 act as heat sinks during operation of the light source to remove heat generated and disperse it through the socket.

In the preferred embodiment, the circuit board 16 supporting the LEDs and circuit traces is sandwiched between a light pipe 28 and the heat sinking features in the lamp base. A light pipe 28 covers the plurality of light sources 18 and extends away therefrom to a terminal end 30. The preferred light pipe 28 is formed from an optically clear material such as glass, polycarbonate, acrylic or other suitable plastic. In one embodiment the light pipe includes a lower end wall defining a cavity enclosing the LEDs to capture substantially all the light generated by the LEDs. The wall may also mate with the first side of the circuit board 16.

Figure 5:
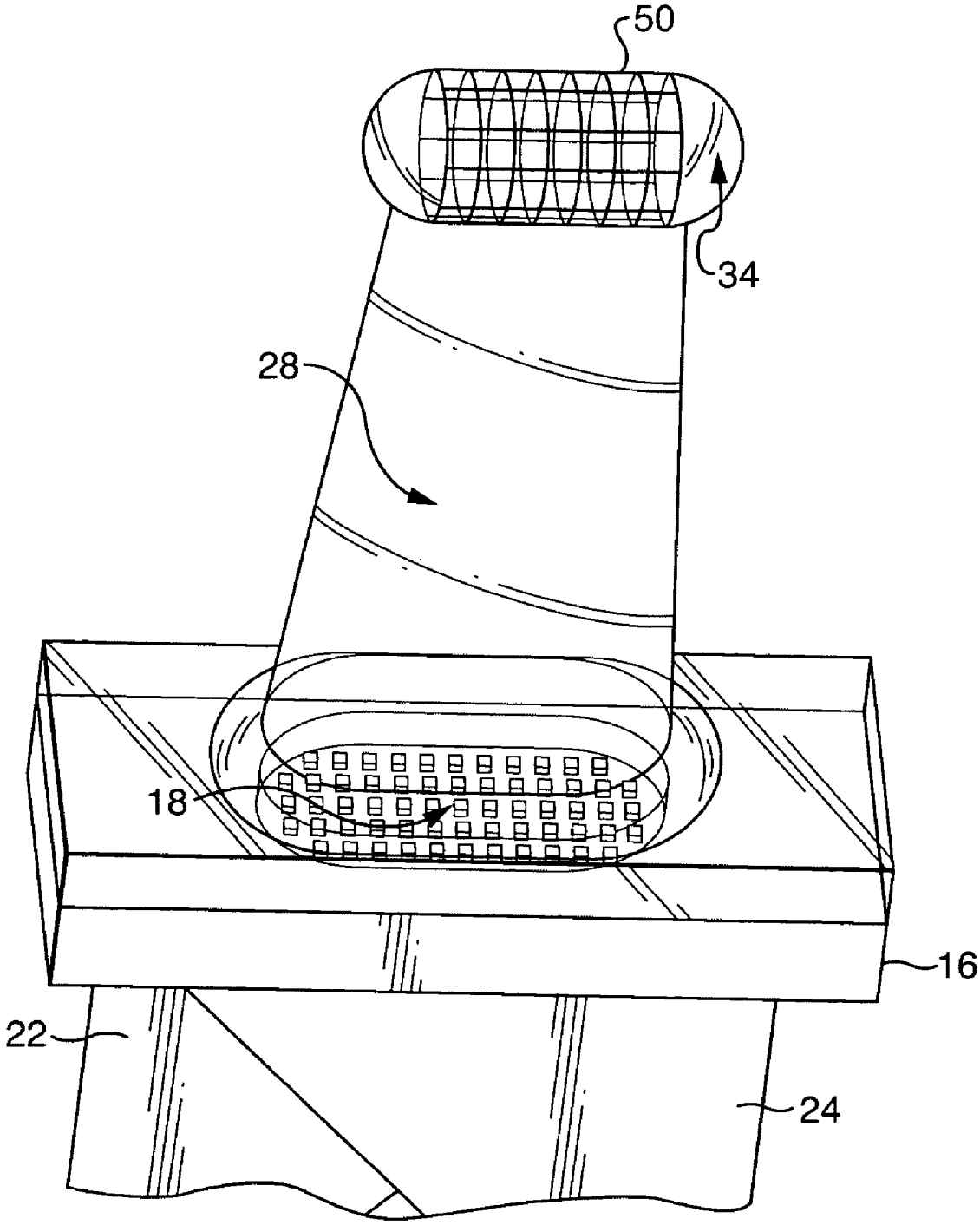
FIG. 5 is a diagrammatic perspective view of an LED layout, light pipe and light radiator.

A light radiator 34 is affixed to the terminal end 30 and a light opaque shroud 33 surrounds the light pipe 28 to keep the light generated by the solid-state light source from exiting the light pipe 28 other than through the light radiator 34. The light radiator 34 is preferably chosen from the same material as the light pipe 28, and if not molded as an original extension of the light pipe 28 may be attached by any suitable method to the light pipe 28, such as by gluing with a light-transparent glue. Additionally, the radiator 34 can be formed with helical grooves 50 as shown in FIG. 5, or facets to further mimic the spectral emission of an incandescent source. One of the advantages of this solid-state light source is the positioning of the centerline 52 of the radiator 34 at the same relative height as the centerline 130 of the incandescent bulb 120. This allows the solid-state light source to use all of the advantages of the lamp reflector, something that was not achieved by previous attempts at substituting solid-state light sources for incandescent ones.

The shroud 33 may be made in two halves, or hinged as a clamshell to envelope the majority of the light pipe 28, the circuit board 16, the LEDs 18 and the contacts 22, 24. The contacts 22 and 24 initially have straight legs 40. The halves of the shroud 33 may close one to the other and to be bonded in the assembly. The exposed leg ends 40 of the contacts 22, 24 are then bent up over the sides of the shroud 33 and housing to be located in the axial direction along the exterior of the lamp base. The light pipe 28 is designed to provide total internal reflection of the generated light, at least along the main shaft portion of the light pipe 28. The light transmitted through the light pipe 28 is then emitted in the filament like head portion, light radiator 34. There are numerous ways of making the shroud 33. It is a matter of design choice as to how to sheath the internal assembly to enclose the light pipe, the LEDs on the circuit board and the electrical contacts with the shroud, and the base. To aid in inserting the light source 10 into a socket it is preferred that the outer surface of the shroud 33 be roughened, as by knurling or pebbling, as is shown at 35 in FIG. 2.

Figure 7:
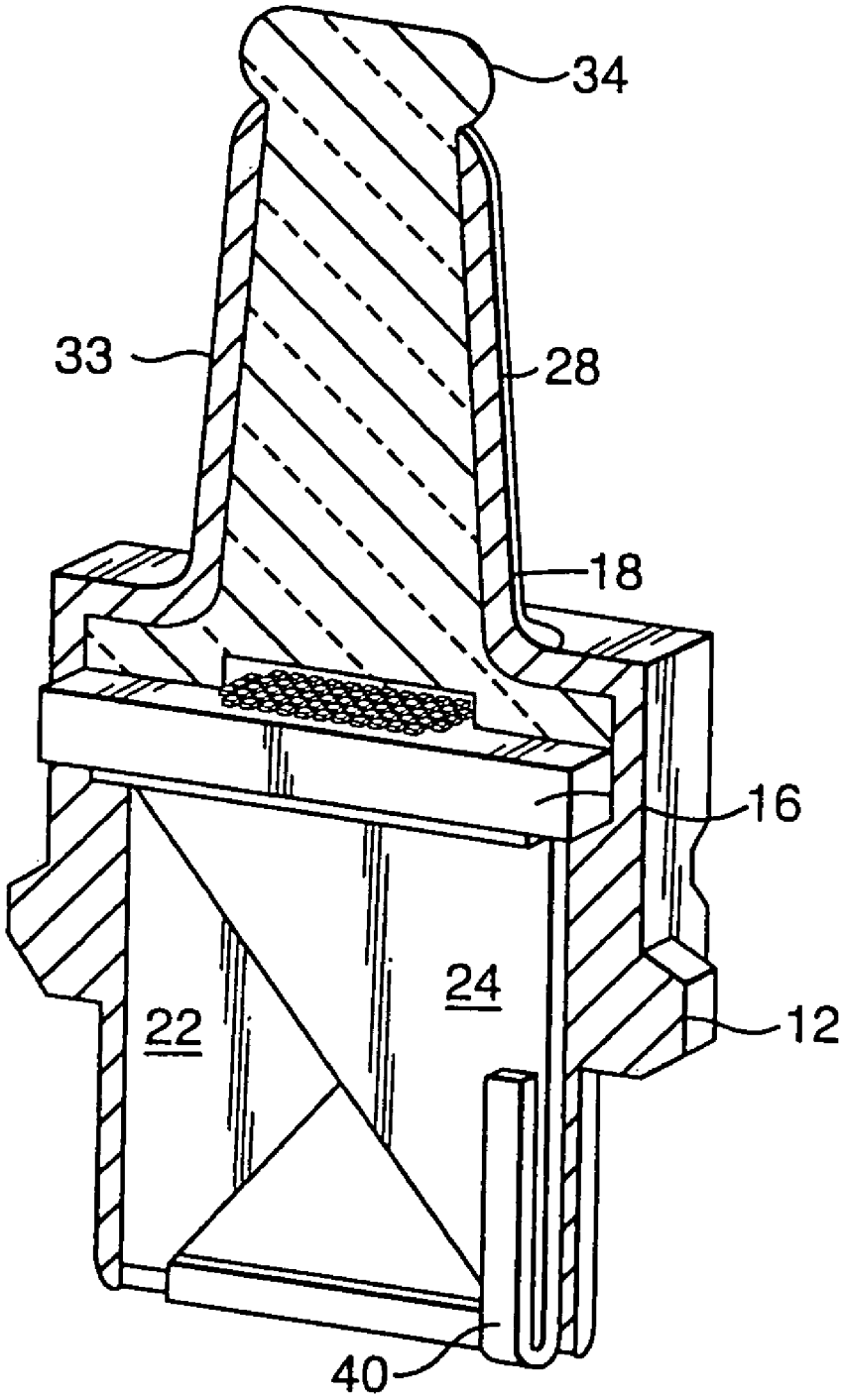
FIG. 7 shows a cross sectional, schematic view of a preferred embodiment of the lamp.

FIG. 7 shows a cross sectional, schematic view of a preferred embodiment of the lamp. The electrical contacts 22 and 24 are mated to the second side of the circuit board 16 for electrical contact. The first side 20 of the circuit board 16 supports an array of LEDs 18. Enclosing and extending away from the LEDs 18 is a light pipe 28 ending at a light radiator 34 shaped and positioned to mimic the characteristics of a standard radiator, in this case a filament. Surrounding the light pipe 28 is a shroud 33. The shroud 33 substantially blocks light from emerging prematurely in patterns different from that of the lamp being the mimicked. In this embodiment the shroud 33 is formed as an extension of the base 12. This embodiment may be formed by forming a subassembly of the circuit board 16, the contacts 22, 24, the light pipe 28 and optionally the radiator 34. The subassembly may then be insert molded as an inclusion in an outer shell forming the base and shroud. The surrounding shell forming the base and shroud may equally be assembled be as several pieces glued, sonically welded, or similarly assembled by known methods. The contact ends 40 are then bent into place and depending on the option, the radiator 34 is attached if necessary.

Figure 8:
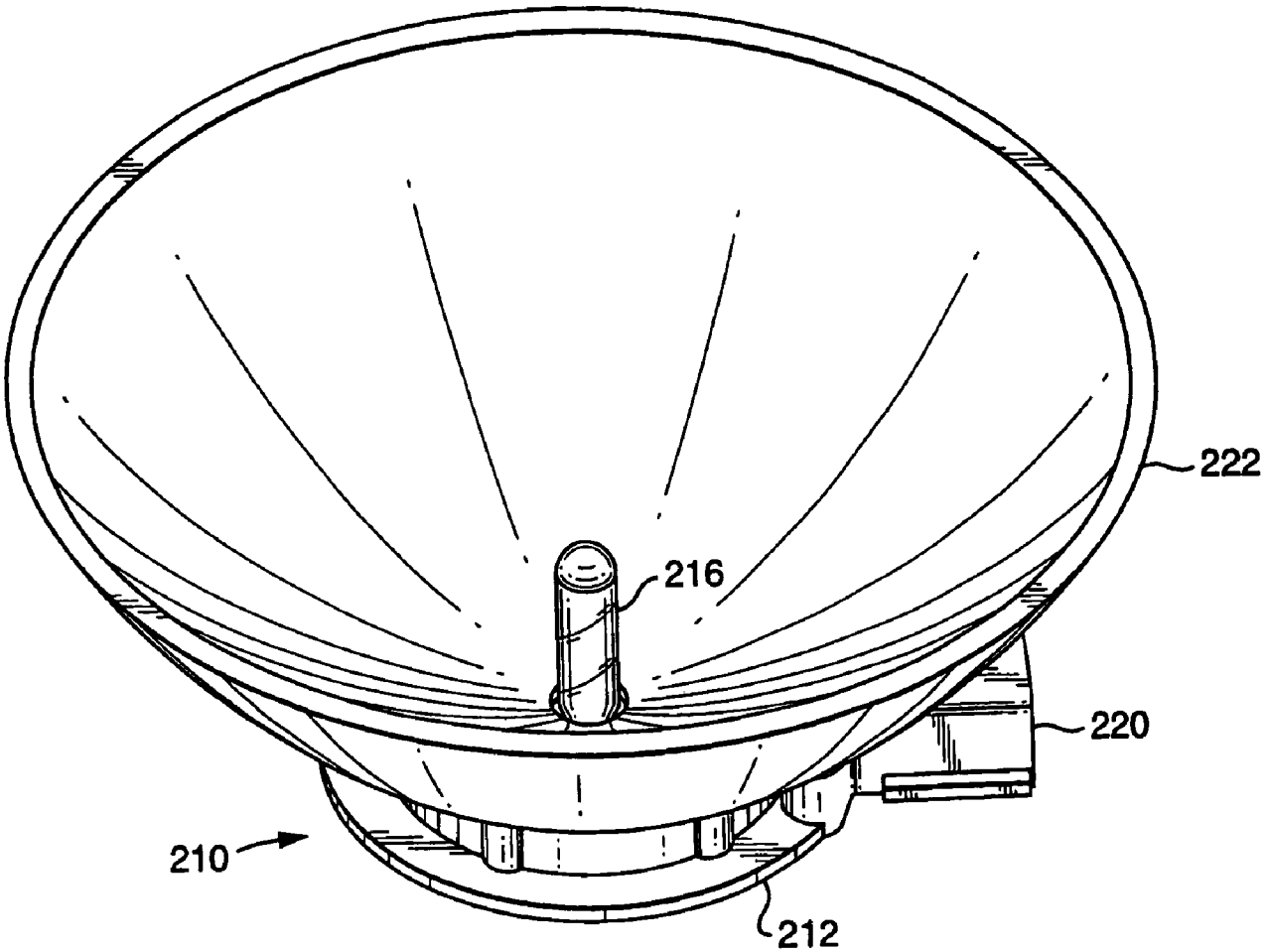
FIG. 8 shows a perspective view of an LED lamp assembly in a reflector.
Figure 9:
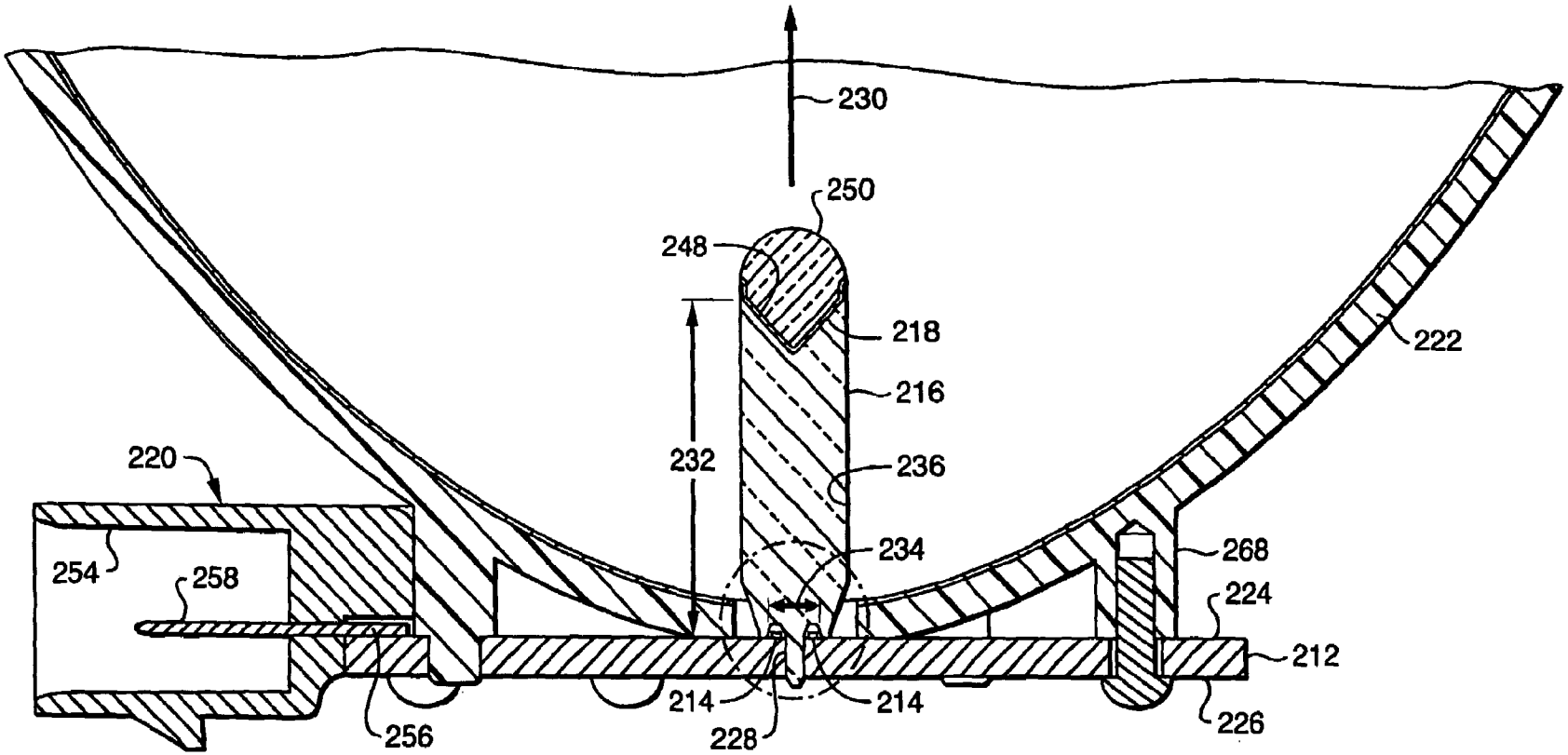
FIG. 9 shows a cross sectional view of an LED lamp assembly and reflector partially broken away.
Figure 10:
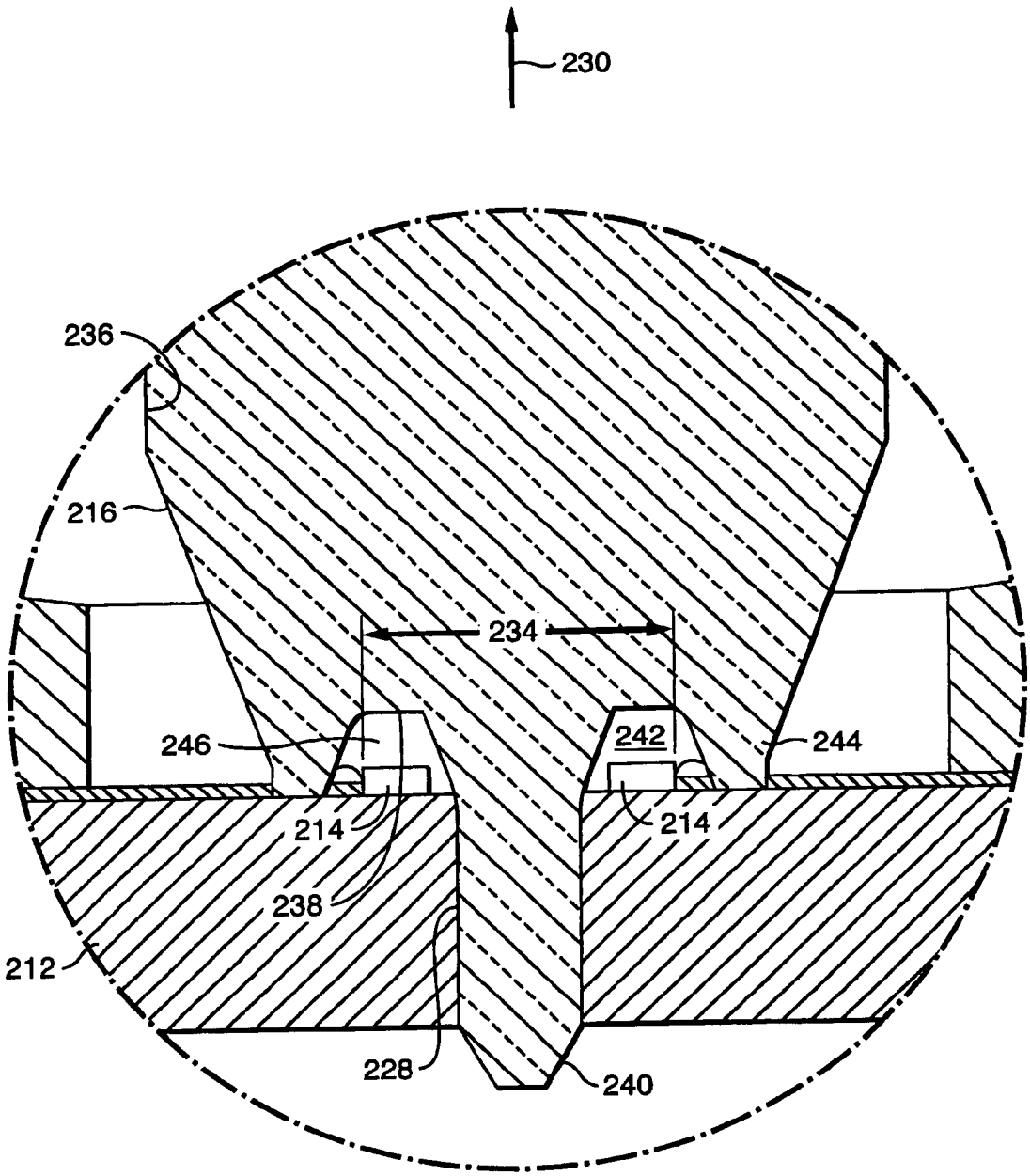
FIG. 10 shows a magnified view of a portion of the LED lamp assembly of FIG. 9.
Figure 11:
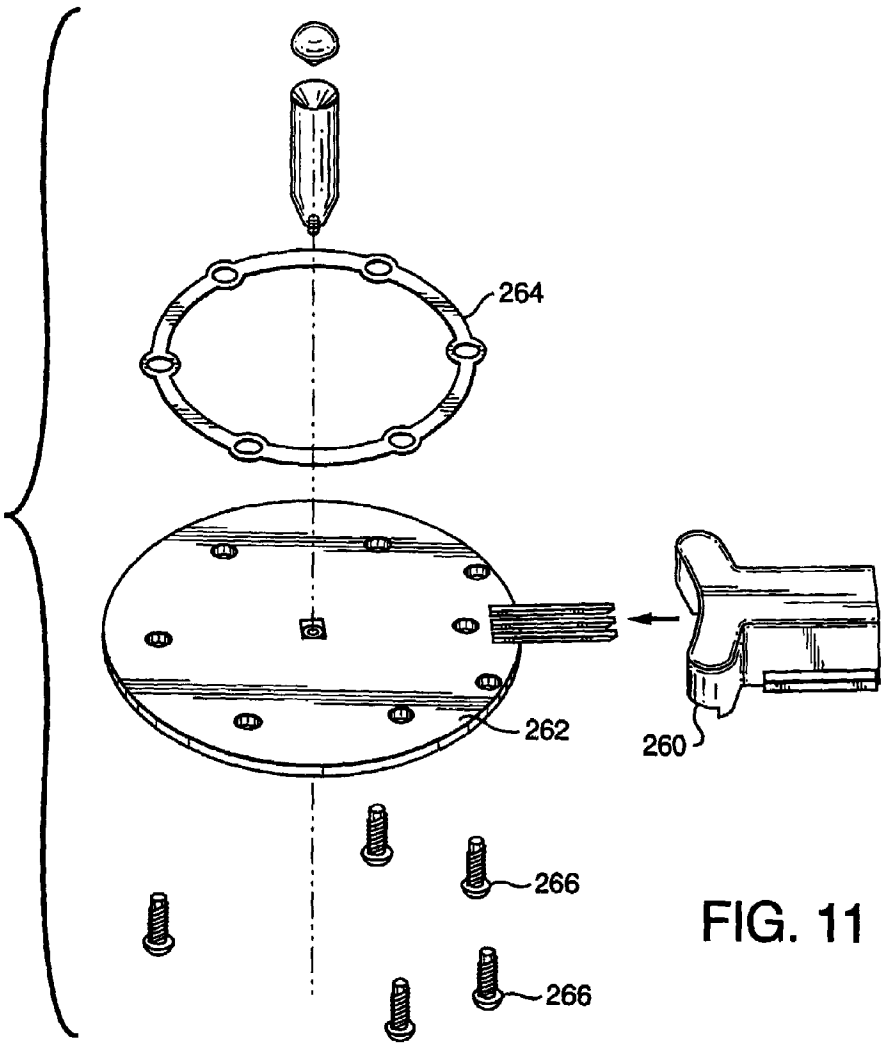
FIG. 11 shows an exploded view of the LED lamp assembly of FIG. 9.

FIG. 8 shows an LED lamp assembly 210 in a reflector. FIG. 9 shows a cross sectional view of an LED lamp assembly and reflector partially broken away. The LED lamp assembly 210 includes a support plate 212, a plurality of LED light sources 214, an axially extending light guide 216, a light deflector 218, and an electric input coupler 220, for use in an optical housing 222

The support plate 212 is generally a planar body with a first side 224 and a second side 226 to locate and support on the first side 224 a plurality of LED light sources 214 in a central region. The preferred support plate 212 is formed from a circuit board with good heat conductive features to conduct heat away from the plurality of LED light sources 214. Alternatively, the support plate 212 may be formed from copper, aluminum or a similar material of high thermal conductivity that is then electrically insulated, at least in appropriate regions to prevent electrical short-circuiting of the LED light sources 214. The support plate 212 may further support electrically isolated electrical circuit traces placed and arranged to supply electrical power to any intermediate electric control circuitry for the LED light sources 214 or directly to the LED light sources 214 as the case may be and as is known in the art. In one embodiment the support plate 212 was a metal clad printed circuit board. The preferred support plate 212 is formed with a wall 228 defining a through passage to help mount and aligned the light guide 216. The support plate 212 is mounted so the light guide 216 may be extended into a reflector or optical housing 222. The second side 226, the rear side, of the support plate 216 is preferably exposed to the exterior, ambient air for heat dissipation. Heat sinking features, as known in the art may be formed on or attached to the second side 226 (the rear or exterior side) of the support plate 212.

Supported on the support plate 212 is a plurality of LED light sources 214 arranged and mounted to generally point in a common direction (axis 230). The preferred LED light sources 214 are high-powered white light LEDs such as are available from Osram Opto Semiconductor. Preferably the LED light sources 214 are chips mounted "chip on board" fashion directly on the support plate 212. This provides the best heat conduction to the support plate 212, and the best light emission from the LED light sources 214 (chips). The LED light sources 214 are preferably arranged as a cluster covering a relatively small area in a middle portion of the support plate 212 and surrounding the through passage formed by wall 228. For example, the LED light sources 214 may be arranged as a grid, a square or as one or more concentric circles on the support plate 212 and arrayed around the through passage. It is preferred that the LED light sources 214 be tightly arranged near a central portion of the support plate 212, and arrayed around the through passage. The LED light sources 214 may be electrically coupled as is known in that art, for example by electrically conductive traces formed on the support plate 212.

Over and in axially alignment with LED light sources 214 is an axially extending, light transmissive, light guide 216. The light guide 216 extends axially away from the support plate 212 and the LED light sources 214. The preferred light guide 216 has an axially extension 232 two or more times as large as the smallest transaxial LED cluster spanning diameter 234. The preferred light guide 216 comprises a circular cylindrical shaft having an internally reflecting wall 236 having an input end 238. The preferred cylindrical light guide 216 is a circular cylinder with a light input end 238 located adjacent the LED light sources 214. The preferred input end 238 is formed with sufficient area transverse to the axis 230 to span the area of the plurality of the LED light sources 214. It is understood that additional LED's may be placed outside the span of the light guide input, but such outliers would be extraneous as to the present invention. The input end 238 is then located and structured to receive a substantial portion, if not all of the light emitted by the LED light sources 214 clustered to feed the light guide 216. The light guide 216 may be securely braced or fixed against the support plate 212. The preferred input end 238 is additionally formed to mechanically couple to the support plate 212. In one embodiment the input end 238 included an axial extending nose 240 to couple or in or extend through the passage defined by wall 228. By coupling the nose 240 to the passage wall 228, the light guide 216 may be aligned and fixed in position. Alternatively the light guide 216 may be fastened to the support plate 212 by a screw, rivet, epoxy or other convenient means as known in the art.

The preferred input end 238 was further formed with one or more recesses 242 to close with the support plate 212 to thereby enclose one or more of the LED light sources 214 in a resulting defined cavity or cavities between the support plate 212 and the light guide 216. In one embodiment, a circumferential edge 244 of the light guide 216 extended toward the support plate 212 as an exterior footing for the cylindrical light guide 216, adjacent the support plate 212 and abutting the support plate 212 to brace the light guide 216, and thereby stabilize the light guide 216. Between the nose 240 and the circumferential edge 244, formed in the input end 238 of the light guide 216, was a recess 242 (shown as empty on one side and epoxy 246 filled on the other for clarity) with sufficient volume to enclose the plurality of LED light sources 214. The recess 242 may be subsequently filled with a transparent epoxy 246 to enclose the LED light sources 214, to further brace or couple the support plate 212 and light guide 216 and to enhance light coupling between the LED light sources 214 and the light guide 216.

The light guide 216 extends away from the input end adjacent the LEDs to a distal end located in the body of the optical housing, and preferably the light guide extends to a focal point of the optical housing 222. The light guide 216 further includes at least one light deflector 218 to direct the light received in the light guide 216 generally in a direction transverse to the axis 230. The light deflector 218 (or deflectors) may be one or more surfaces extending in, or along the light guide 216 to intercept light traversing the light guide 216, generally in the axial direction 230, and reflect or refract such intercepted light sideways, at an angle (generally transverse) to the axis 230 to leave the light guide 216 and to project such deflected light to a field or device 222 to be illuminated by the LED lamp assembly 210. The preferred deflector 218 comprises a reflecting or refracting surface extending at an angle to the axis 230 within the light conducting path of the light guide 216 and adjacent a transparent wall 236 portion of the light guide 216. In a preferred embodiment, the deflector 218 comprises a conical wall 248 defining a coaxial, conical recess formed in the distal end of the light guide 216. The conical wall 248 then reflects light traversing the light guide 216 to the side. With a conical wall 248 of 45 degrees to the axis 230, the emitted light is then generally deflected 90 degrees to the side (spread from the 90 degrees deflection is understood). In one embodiment an aluminized cone 250 with a decorative hemispherical dome was conformally nested in the conical recess to enhance transverse reflection of the axial light to the side. The input end 238 disposed adjacent the LED light sources 214 receives light emitted by the LED light sources 214 and conducts such light through the light guide 216 to the deflector 218. The deflector 218 then reflects light sideways to the reflector or optical housing 222. In combination the assembly functions as if the LEDs were concentrated as a cluster at the distal end of a shaft, where the focal point or other desired optical position of the optical housing is located, while at the same time the heat generated by the LEDs is conveniently dispersed by being physically adjacent the exterior wall (support plate) with heat sinking features. The diameter and axial length of the light guide 216 and the angle and location of the deflecting surface 248 may be easily altered in forming the light guide 216, while the rest of the lamp structure is substantially retained as a standardized unit. In this way one basic product may be readily altered or adopted for use in a variety of reflectors or optical housings.

The preferred input coupler 220 includes a socket 254 for receiving a standard power plug (USCAR). The preferred coupler 220 has electrical connections, such as lugs 256 extending from power contacts 258 supported in the socket 254 to electrical connections made to the circuit elements supported on the support plate 212. For example, lugs 256 may be molded in place to extend from the socket 254 to the support plate 212. The support plate 212 side ends of the lugs 256 may be formed with spring contact ends to touch the electrical traces. The contact lugs 256 may be brought into contact with electrical traces formed on the support plate 212 thereby completing electrical connection through the coupler 220 to the support plate 212 and thereafter to the LED light sources 214. The input coupler 220 may be formed with a slot, crevice or ledge 260 that may be conformally fitted to the edge 262 of the support plate 212. Screws, rivets or similar attachments may be used to couple the support plate 212 to the coupler 220. Similarly, corresponding alignment keys may be formed in or on the support plate 212 and the coupler 220 to align and brace one with respect to the other for proper alignment during assembly and thereafter as is known in the art.

The support plate 212 may be coupled to the rear of an optical housing 222 with glue or a similar bonding material or method. One preferred method is to apply a ring of double-sided tape 264 to the interior face 224 of the support plate 212. The tape 264 may be pressed against the corresponding surface on the rear of an optical housing 222, so as to position the lamp assembly 210 in a preferred optical position with respect to the reflector 222. The double-sided tape 264 then serves both as a binding mechanism and as a seal. Additional mechanical couplers may be used to bind the support plate 212 to the optical housing 222, such as rivets or screws 266 that for example extend through the double-sided tape to thereby assist in pressing the tape 264 in contact with the support plate 212 and the optical housing 222.

A coupling wall 268 may also be formed with or along the support plate 212 or on the optical housing 222 to enclose or extend between the support plate 212 and the optical housing 222 to conformally close with a surface of an optical housing 222. For example a coupling extending circumferentially around the light guide 216, and coupled the circuit board may be formed to have a top edge that conforms to a surface of an optical housing 222, reflector or similar body to be illuminated by the lamp. The circumferential wall 268 may be glued, sonically welded, screwed, riveted, or similarly coupled to the optical housing 222. The circumferential wall 268 may be formed with supporting mechanical couplers extending from the wall 228 for attachment to the optical housing 222. The circuit board and the circumferential wall 268 then define a cavity adjacent the support plate 212 sufficient to retain circuit elements, for example surface mounted devices attached to the support plate 212 for electrically controlling the lamp assembly.

Figure 12:
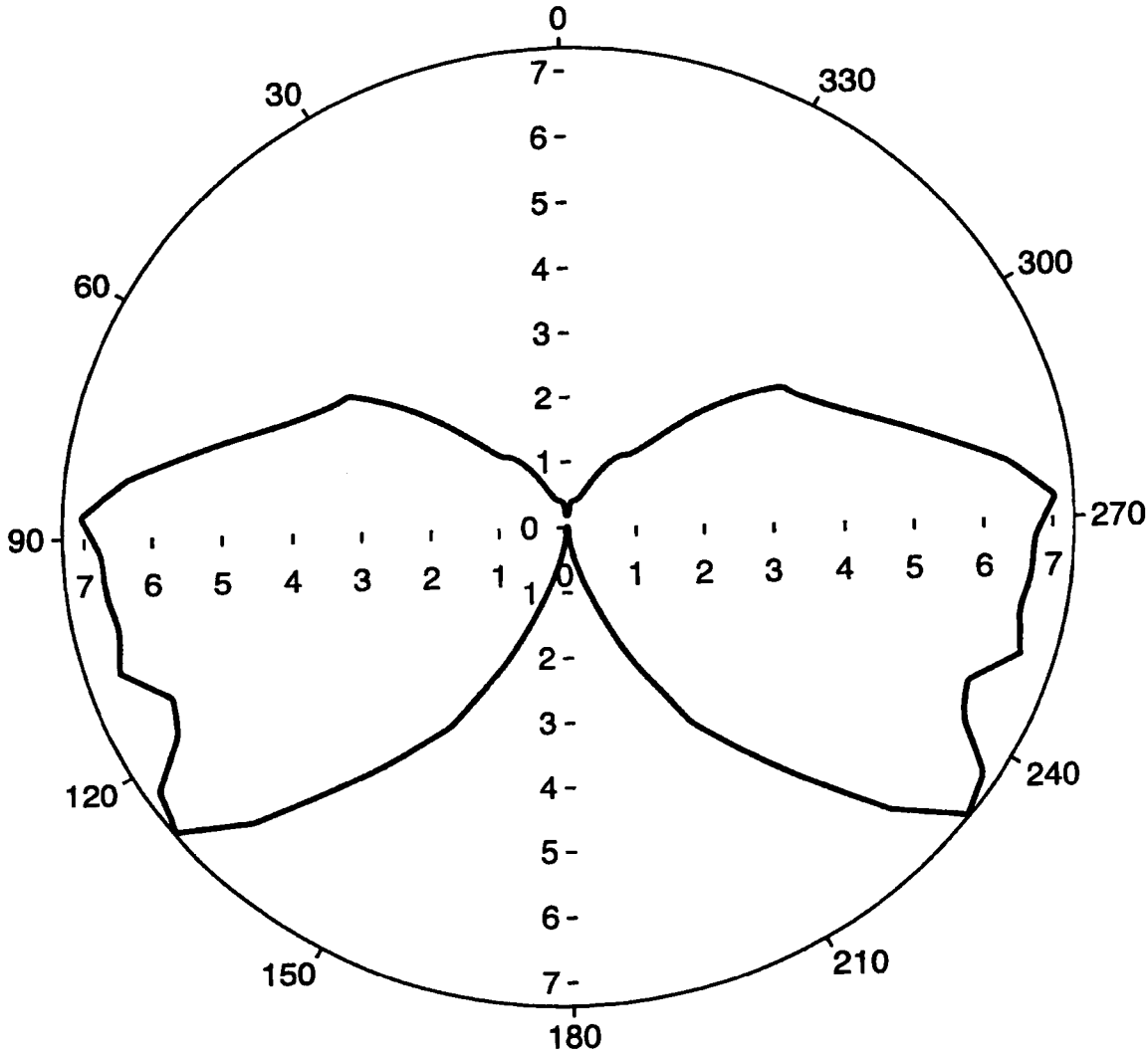
FIG. 12 shows a chart of the light pattern emitted by one embodiment of the light guide.

In one embodiment the light guide was a circular cylindrical, clear acrylic tube. Polycarbonate may also be used. The tube had a coaxial, 45-degree conical recess formed in the distal end. The circular cylinder was 8 millimeter in diameter, and extended 24 millimeters from the support plate. A metallized cone was positioned in the conical recess to act as a light deflector. Projecting from the foot of the cylinder was a 1 millimeter diameter, 4 millimeter long nose. Adjacent the nose was a recessed ring to enclose eight (8) LED chips mounted at equal angles around a circle on the support plate. Trace circuits formed on the support plate electrically coupled the eight LED chips. The light guide cylinder was beveled at 20 degrees to the axis (70 degrees to the support plate) to deflect light up the light guide cylinder. The light guide cylinder had an optical cavity length of approximately 24 millimeters. There were eight LED dies arrayed as a circle around a central passage through the support plate. The LED circle had a diameter (LED center to LED center) of about 4 millimeters. The LEDs were about 0.5 millimeters on a side. The support plate was circular with about an 80 millimeter diameter. Six equally spaced screw holes were spread for screwed attachment of the support plate to a reflector. There were two more screw holes for attachment of the circuit board to the socket assembly. The resulting lamp assembly was approximately 72% light efficient at projecting light than was a lamp without the light guide, with most of the light dispersed approximately radial from the deflector center at angles 30 to 120 degrees measured up from the axis, with most of the light emitted from between 45 and 90 degrees. FIG. 12 shows a chart of the light pattern emitted by one embodiment of the light guide.

The light guide may be attached to the circuit board in a variety of fashions. The light guide may extend into a passage formed in the circuit board and to be mechanically coupled to the circuit board in a compression fit, capped by a riveted ring, glued to the circuit board or similarly captured in place. Similar, a coupling may extend through a passage in the circuit board and into the light guide. The extending mechanical coupler then extends through a passage formed in the circuit board and is mechanically coupled to the light guide to secure the light guide to the circuit board. For example, the mechanical coupler may be a threaded coupler coupled axially to the light guide. The light guide and the circuit board may be registered with respect to each other for proper optical output. For example, mechanical registration features may be formed on the light guide, and the circuit board. These features are structured to have corresponding mechanically mateable features defining a preferred registration of the light guide with respect to the circuit board when the first registration feature is properly mated to the second registration feature. For example, a protrusion on one and a hole on the other may be used. Alternatively, the mechanical coupling between the light guide and the circuit board may carry the registration feature. For example, the light guide may have a non-circular axial projection, and the circuit board may have a correspondingly shaped passage to snuggly receive the non-circular projection and thereby define a preferred registration of the light guide with respect to the circuit board when the non-circular projection is properly mated in the shaped passage.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An LED lamp assembly comprising:

a heat conductive support plate with a first side and a second side;

a plurality of LED light sources arranged and mounted on the first side of the support plate;

an axially extending, light transmissive, light guide having an input end with an area sufficient to span the mounted LED light sources, and at least one light deflector, the input end disposed adjacent the LED light sources to receive light emitted by the LED light sources and to conduct such light axially through the light guide to the deflector for projection sideways at an angle to the axis, and having an input coupler including a socket portion, the coupler having electrical connections extending from contacts supported in the socket to electrical connections made to circuit elements supported on the support plate.

2. An LED lamp assembly comprising:

a heat conductive support plate with a first side and a second side;

a plurality of LED light sources arranged and mounted on the first side of the support plate;

an axially extending, light transmissive, light guide having an input end with an area sufficient to span the mounted LED light sources, and at least one light deflector, the input end disposed adjacent the LED light sources to receive light emitted by the LED light sources and to conduct such light axially through the light guide to the deflector for projection sideways at an angle to the axis, and having a housing including a wall extending circumferentially around the light guide, and coupled the circuit board, the wall further supporting a mechanical coupler extending from the wall for attachment to an optical housing.

3. The LED lamp assembly in claim 2, wherein the wall, and circuit board define a cavity sufficient to retain a circuit element for electrically controlling the lamp.

4. An LED lamp assembly comprising:

a heat conductive support plate with a first side and a second side;

a plurality of LED light sources arranged and mounted on the first side of the support plate;

an axially extending, light transmissive, light guide having an input end with an area sufficient to span the mounted LED light sources, and at least one light deflector, the input end disposed adjacent the LED light sources to receive light emitted by the LED light sources and to conduct such light axially through the light guide to the deflector for projection sideways at an angle to the axis, and wherein a portion of the light guide extends into a passage formed in the circuit board and is mechanically coupled to the circuit board.

5. An LED lamp assembly comprising:

a heat conductive support plate with a first side and a second side;

a plurality of LED light sources arranged and mounted on the first side of the support plate;

an axially extending, light transmissive, light guide having an input end with an area sufficient to span the mounted LED light sources, and at least one light deflector, the input end disposed adjacent the LED light sources to receive light emitted by the LED light sources and to conduct such light axially through the light guide to the deflector for projection sideways at an angle to the axis, and wherein a portion of the light guide extends into a passage formed in the circuit board and is glued to the circuit board.

6. An LED lamp assembly comprising:

a heat conductive support plate with a first side and a second side;

a plurality of LED light sources arranged and mounted on the first side of the support plate;

an axially extending, light transmissive, light guide having an input end with an area sufficient to span the mounted LED light sources, and at least one light deflector, the input end disposed adjacent the LED light sources to receive light emitted by the LED light sources and to conduct such light axially through the light guide to the deflector for projection sideways at an angle to the axis, and wherein a portion of a mechanical coupler extends through a passage formed in the circuit board and is mechanically coupled to the light guide to secure the light guide to the circuit board.

7. An LED lamp assembly comprising:

a heat conductive support plate with a first side and a second side:

a plurality of LED light sources arranged and mounted on the first side of the support plate;

an axially extending, light transmissive, light guide having an input end with an area sufficient to span the mounted LED light sources, and at least one light deflector, the input end disposed adjacent the LED light sources to receive light emitted by the LED light sources and to conduct such light axially through the light guide to the deflector for projection sideways at an angle to the axis, and wherein the mechanical coupler is a threaded coupler coupled axially to the light guide.

8. An LED lamp assembly comprising:

a heat conductive support plate with a first side and a second side;

a plurality of LED light sources arranged and mounted on the first side of the support plate;

an axially extending, light transmissive, light guide having an input end with an area sufficient to span the mounted LED light sources, and at least one light deflector, the input end disposed adjacent the LED light sources to receive light emitted by the LED light sources and to conduct such light axially through the light guide to the deflector for projection sideways at an angle to the axis, and wherein the light guide has a first mechanical registration feature, and the circuit board has a second and corresponding mechanical registration feature defining a preferred registration of the light guide with respect to the circuit board when the first registration feature is properly mated to the second registration feature.

* * * * *